US007028718B2

(12) United States Patent
Kobayashi et al.

(10) Patent No.: US 7,028,718 B2
(45) Date of Patent: Apr. 18, 2006

(54) METHOD FOR MANUFACTURING A FABRIC AND AN APPARATUS FOR MANUFACTURING A FABRIC

(75) Inventors: Tazaemon Kobayashi, Imadate-gun (JP); Izumi Takemoto, Shinagawa-ku (JP); Yoko Kobayashi, Minato-ku (JP); Tsumugi Fujita, Kawasaki (JP)

(73) Assignee: NUGGET Co., Ltd., Tokyo (JP)

( * ) Notice: Subject to any disclaimer, the term of this patent is extended or adjusted under 35 U.S.C. 154(b) by 229 days.

(21) Appl. No.: 10/685,458

(22) Filed: Oct. 16, 2003

(65) Prior Publication Data

US 2004/0079432 A1 Apr. 29, 2004

(30) Foreign Application Priority Data

Oct. 16, 2002 (JP) ..... 2002-301915

(51) Int. Cl.
*D03D 49/50* (2006.01)

(52) U.S. Cl. ..... 139/116.1; 139/1 E; 139/437; 139/449; 139/450; 139/133; 139/190

(58) Field of Classification Search ..... 139/1 E, 139/116.1, 437–439, 449, 450, 133, 137, 139/171, 178, 190, 344
See application file for complete search history.

(56) References Cited

U.S. PATENT DOCUMENTS 3,378,041 A 4/1968 Moessinger
4,503,371 A * 3/1985 Sugita ..... 318/443
4,734,634 A * 3/1988 Kito et al. ..... 318/778
4,964,891 A * 10/1990 Schaefer ..... 65/377
5,042,533 A * 8/1991 Kuwahara et al. ..... 139/1 R
5,090,452 A * 2/1992 Dondi Benelli ..... 139/100
5,162,717 A * 11/1992 Tamura ..... 318/778
5,176,184 A * 1/1993 Yamada ..... 139/435.2
5,293,907 A * 3/1994 Tamura ..... 139/1 E
5,630,262 A * 5/1997 Tanaka ..... 28/184

FOREIGN PATENT DOCUMENTS

CH 96 173 A 9/1922

(Continued)

OTHER PUBLICATIONS

*Machine Weaving*, (the Ministry of Education, Science and Culture), Jikkyo Shuppan, Mar. 10, 1954, pp. 1-199.
Patent Abstracts of Japan, vol. 1996, No. 07, Jul. 31, 1996.

*Primary Examiner*—Danny Worrell
*Assistant Examiner*—Robert H. Muromoto
(74) *Attorney, Agent, or Firm*—Jacobson Holman PLLC

(57) ABSTRACT

The present invention provides a method for manufacturing a fabric and an apparatus for manufacturing a fabric that enable weaving of weak fibers including monofilaments of noble metal such as 24-carat gold. The present invention provides a method for manufacturing a fabric using a power loom driven by driving means, comprising the steps of: (a) separating a warp into an upper part and a lower part to form a shed by means of rotation of said driving means; (b) accelerating a weft thread toward said shed by means of rotation of said driving means; (c) passing said weft thread through said shed by means of rotation of said driving means; (d) decelerating said weft thread passed through said shed by means of rotation of said driving means; (e) returning said warp to close said shed by means of rotation of said driving means; and (f) beating said weft thread inserted into said warp in said step (c) to draw up said weft thread into near side by means of rotation of said driving means; rotational speed of said driving means during said steps (b) and (d) being lower than rotational speed of said driving means during said step (c).

7 Claims, 6 Drawing Sheets

FOREIGN PATENT DOCUMENTS

| | | | |
|---|---|---|---|
| DE | 197 40 307 | A | 3/1999 |
| EP | 0 989 217 | A | 3/2000 |
| GB | 387 742 | A | 2/1933 |
| JP | 8 060496 | A | 3/1996 |
| JP | 2002004150 | A | 1/2002 |

* cited by examiner

METHOD FOR MANUFACTURING A FABRIC AND AN APPARATUS FOR MANUFACTURING A FABRIC

FIELD OF THE INVENTION

The present invention relates to method of manufacturing a fabric and an apparatus for manufacturing a fabric and more particularly to a method of manufacturing a fabric and an apparatus for manufacturing a fabric that can weave a fabric from weak filament, such as monofilaments of noble metal.

BACKGROUND ART

Conventionally, it has been difficult to weave a fabric from a very weak fiber, especially monofilaments of fine gold, an extrafine fiber, or an extra-weak fiber. Fabric woven from monofilaments of noble metal, especially fabric woven from monofilaments of fine gold, can be expected to semi-permanently retain its original luster and beauty and demand a high price as a material for ornaments. Attempts have therefore been made to produce such fabric from many years ago. Non-patent document 1 describes the structure of an apparatus for manufacturing a fabric and a method for manufacturing a fabric. Further, the Patent Document 1 discloses a method for weaving a fabric from monofilaments of noble metal and an apparatus for weaving the same.

[Non-Patent Document 1] "Machine Weaving" (the Ministry of Education, Science and Culture, Jikkyo Shuppan, Feb. 25, 1959, p.p 14–193)

[Patent Document 1] Japanese Patent Laid-Open No. 2002-4150

However, by using the method disclosed by the Patent Document 1, it is not possible to weave a fabric from an arbitrary weak fiber, since the method sets a limit on the tensile strength of the fiber to be woven. In this specification, the term "noble metal" will be used to generally refer to metals such as gold, silver, platinum, iridium, and various alloys containing them in combination.

Accordingly, it is an object of the present invention to provide method for manufacturing a fabric and an apparatus for manufacturing a fabric that enable weaving of weak fibers including monofilaments of noble metals such as 24-carat gold.

SUMMARY OF THE INVENTION

The present invention provides a method for manufacturing a fabric using a power loom driven by driving means, comprising the steps of: (a) separating a warp into an upper part and a lower part to form a shed by means of rotation of said driving means; (b) accelerating a weft thread toward said shed by means of rotation of said driving means; (c) passing said weft thread through said shed by means of rotation of said driving means; (d) decelerating said weft thread passed through said shed by means of rotation of said driving means; (e) returning said warp to close said shed by means of rotation of said driving means; and (f) beating said weft thread inserted into said warp in said step (c) to draw up said weft thread into near side by means of rotation of said driving means; a rotational speed of said driving means during said steps (b) and (d) being lower than a rotational speed of said driving means during said step (c).

In the present invention as set forth above, the following motions are generated at predetermined timing by means of the power of the driving means: (a) a shedding motion for separating the warp into an upper part and a lower part to form a shed; (b) an initial picking motion for accelerating the weft thread toward the shed; (c) a picking motion for passing the weft thread through the shed; (d) a terminal picking motion for decelerating the weft thread passed through the shed; (e) a closing motion for closing the shed; and (f) a beating motion for beating the weft thread inserted into the warp to draw up the weft thread into near side. The rotational speed of the driving means is reduced during the initial picking motion and the terminal picking motion.

In this arrangement of the present invention, shock force liable to break the weft thread can be prevented during the initial picking motion for accelerating the weft thread and the terminal picking motion for decelerating the weft thread. In addition, problems such as loosening of the weft are prevented and fabric productivity is enhanced by the apparatus according to the present invention. This is because during the picking motion the rotational speed of the driving means is higher than the rotational speed during the initial picking motion and the terminal picking motion.

Preferably, the rotational speed of the driving means during the initial picking motion and the terminal picking motion is ¼ or less the rotational speed of said driving means during the picking motion.

In this arrangement of the present invention, the fabric productivity is enhanced while breaking of the weft thread is prevented.

Preferably, the driving means is an electric motor and the rotational speed of the electric motor is varied by an inverter.

In this arrangement of the present invention, the rotational speed is smoothly varied with high energy efficiency.

Preferably the driving means is an electric motor and the rotational speed of the electric motor is varied by switching a switch in response to the beating motion by which a reed is moved.

In this arrangement of the present invention, a suitable switch is changed by means of reciprocating motion of the reed performing beating motion and the rotating speed of the driving means is varied on the basis of the position of the switch.

By this arrangement of the present invention, the time for operating the switch can be detected with simple mechanism.

The present invention also provides an apparatus for manufacturing a fabric comprising: driving means for generating rotational force; healds for transferring a warp upward or downward to form a shed at predetermined timing in response to a rotation of said driving means; a shuttle for holding a weft thread and transferred into said shed so as to cross said warp at predetermined timing in response to a rotation of said driving means; a shuttle box for slidably supporting said shuttle and picking said shuttle into said shed at predetermined timing in response to a rotation of said driving means; a reed attached to said shuttle box for beating said weft thread inserted into said warp by picking said shuttle, said reed being reciprocated at predetermined timing by means of a rotation of said driving means to draw up said weft thread into a near side; and means for varying rotational speed of said driving means at predetermined timing.

In the present invention as set forth above, the motion of the healds forming the shed, the motion of picking the shuttle into the shed and the motion of drawing the reed up the weft thread into the near side are performed by means of the rotation of the driving means and the rotational speed of the driving means is varied at predetermined timing.

In this arrangement of the present invention, the rotational speed of the driving means is reduced during motions that tend to apply shock force to the weft thread, whereby the shock force applied to the weft thread is reduced and breaking of the weft thread is prevented.

Preferably said means for varying the rotational speed decreases rotational speed of the driving means at least when the shuttle is accelerated toward the shed and when the shuttle is decelerated after passing through the shed.

Further, in the present invention, the driving means is preferably an electric motor and the means for varying rotational speed is preferably an inverter connected to the electric motor.

Further, in the present invention, the apparatus preferably further comprises a limit switch that is switched by means of reciprocating motion of the shuttle box and the means for varying rotational speed varies the rotational speed of the driving means on the basis of the position of the limit switch.

BRIEF DESCRIPTION OF THE DRAWINGS

The present invention will be best understood in conjunction with the accompanying drawings throughout which like reference numerals generally denote equivalent or similar elements.

DETAILED DESCRIPTION OF THE PREFERRED EMBODIMENTS

Figure 1:
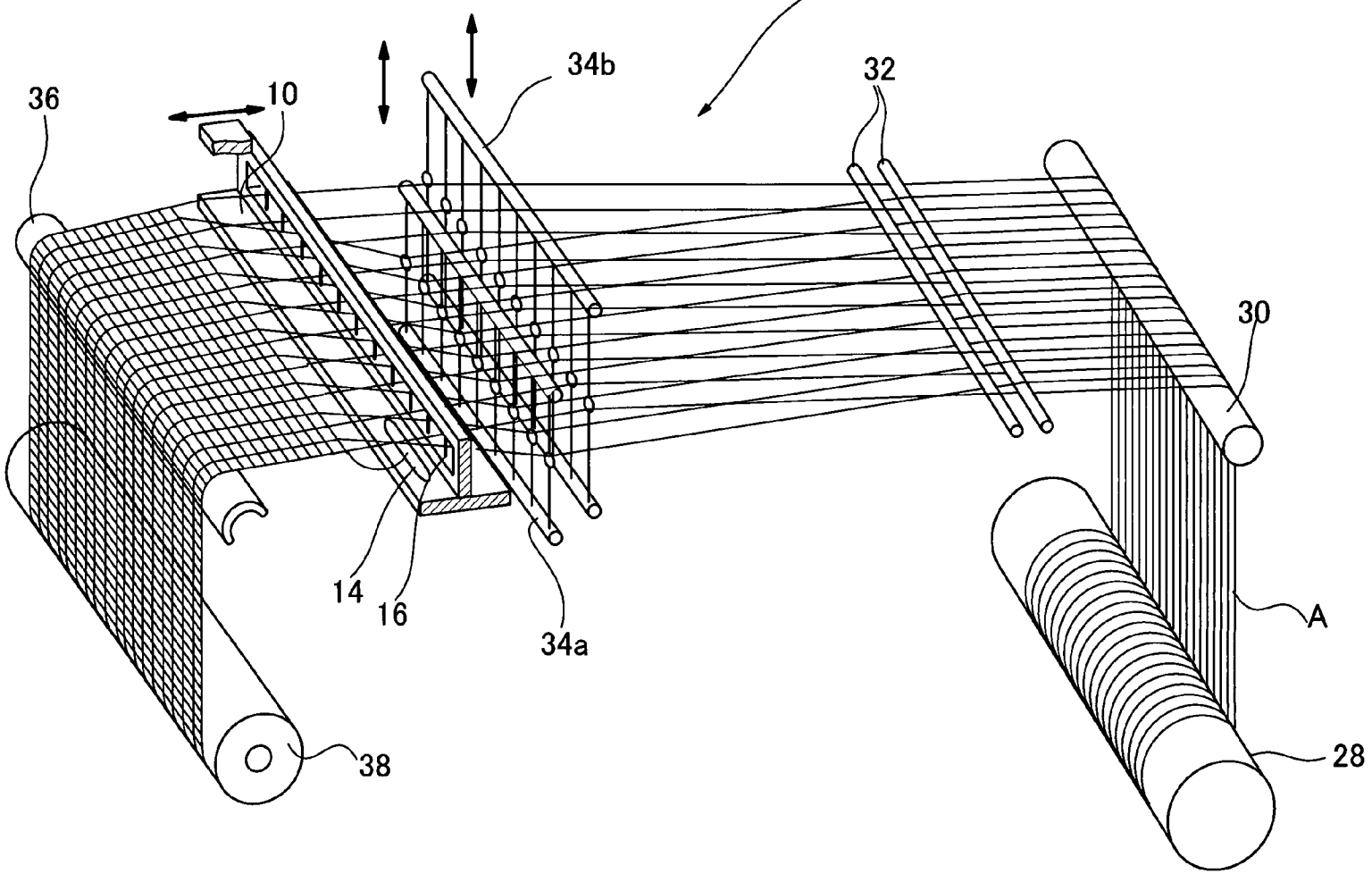
FIG. 1 is a perspective view of an apparatus for manufacturing a fabric according to a preferred embodiment of the present invention.
Figure 2:
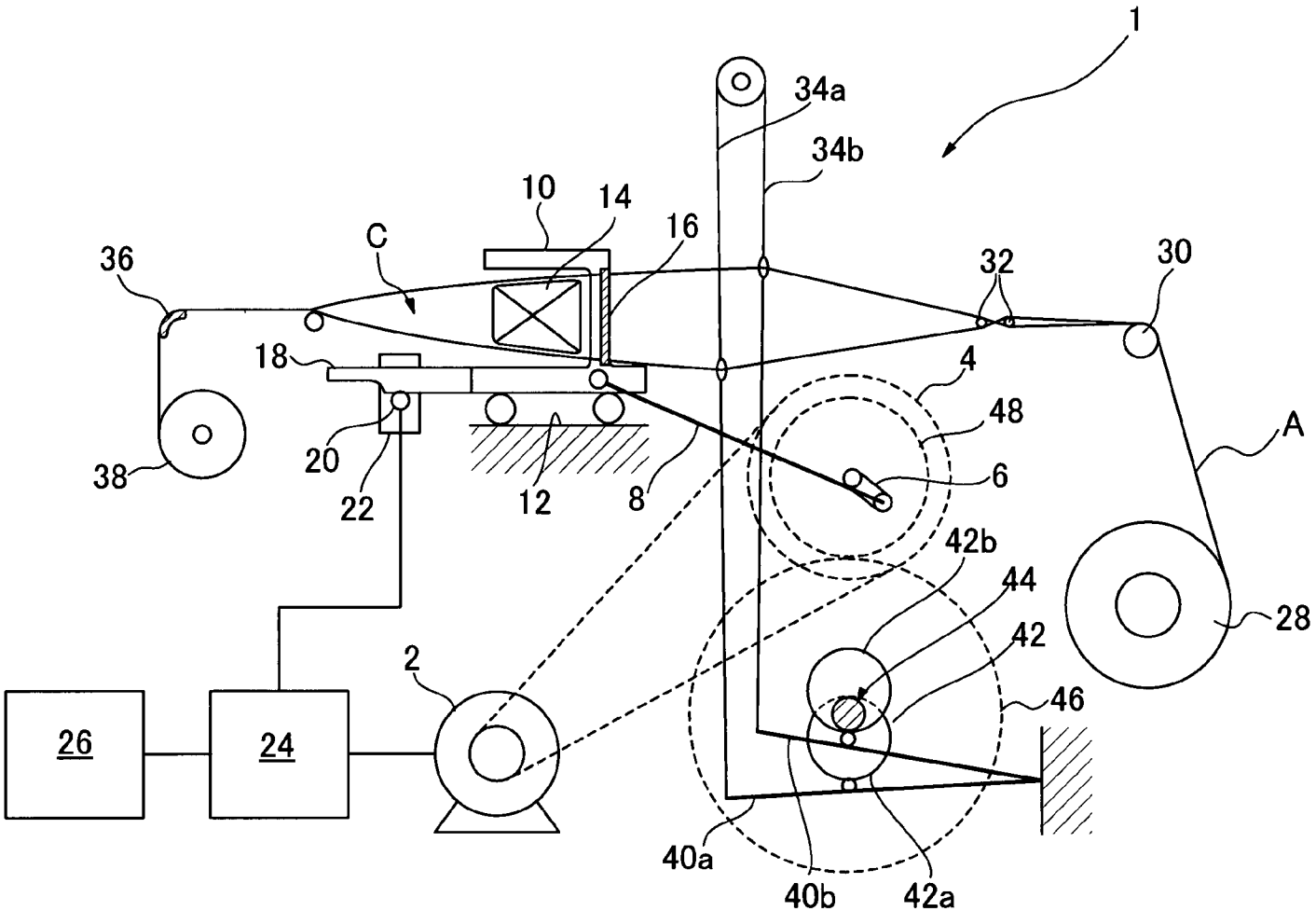
FIG. 2 is a schematic view of the apparatus for manufacturing a fabric according to the preferred embodiment of the present invention.

Preferred embodiments of the present invention will now be described with reference to the accompanying drawings. FIG. 1 is a perspective view of an apparatus for manufacturing a fabric according to a preferred embodiment of the present invention illustrating primary structures of the apparatus. FIG. 2 is a schematic view illustrating relationships among parts of the apparatus. As illustrated in FIGS. 1 and 2, the apparatus 1 according to this embodiment of the present invention comprises driving means, i.e., a motor 2, for generating power, a pulley 4 driven by the motor 2 through a belt, a crankshaft 6 to which the pulley 4 is secured, and a connecting rod 8 connected to the crankshaft 6.

The apparatus 1 according to the embodiment of the present invention further comprises a shuttle box 10 reciprocated by the connecting rod 8, a pair of rails 12 guiding horizontal motion of the shuttle box 10, a shuttle 14 retaining the weft thread and slidably supported in the shuttle box 10, and a reed 16 attached to the shuttle box 10. An extension bar 18 having a shoulder portion is attached to the shuttle box 10. The apparatus 1 further comprises a flexible lever 20 positioned so that the extension bar 18 is in contact with the flexible lever 20, a limit switch 22 attached to the flexible lever 20, means for varying rotational speed, i.e., an inverter 24, that varies the rotational speed of the motor 2 in response to switching of the limit switch 22, and a power supply 26 supplying power to the inverter 24.

The motor 2 is adapted to drive the pulley 4 through the belt. Since the diameter of the pulley 4 is larger than that of the pulley attached to the drive shaft of the motor 2, the rotation of the motor 2 transmitted to the pulley 4 is decelerated. The crankshaft 6 is driven by the pulley 4 and reciprocates the shuttle box 10 along the pair of rails 12 through the connecting rod 8. The reed 16 attached to the shuttle box 10 is a comb-like plate having many slots parallelly extending in the vertical direction and reciprocates together with the shuttle box 10 to beat the weft thread.

Figure 3:
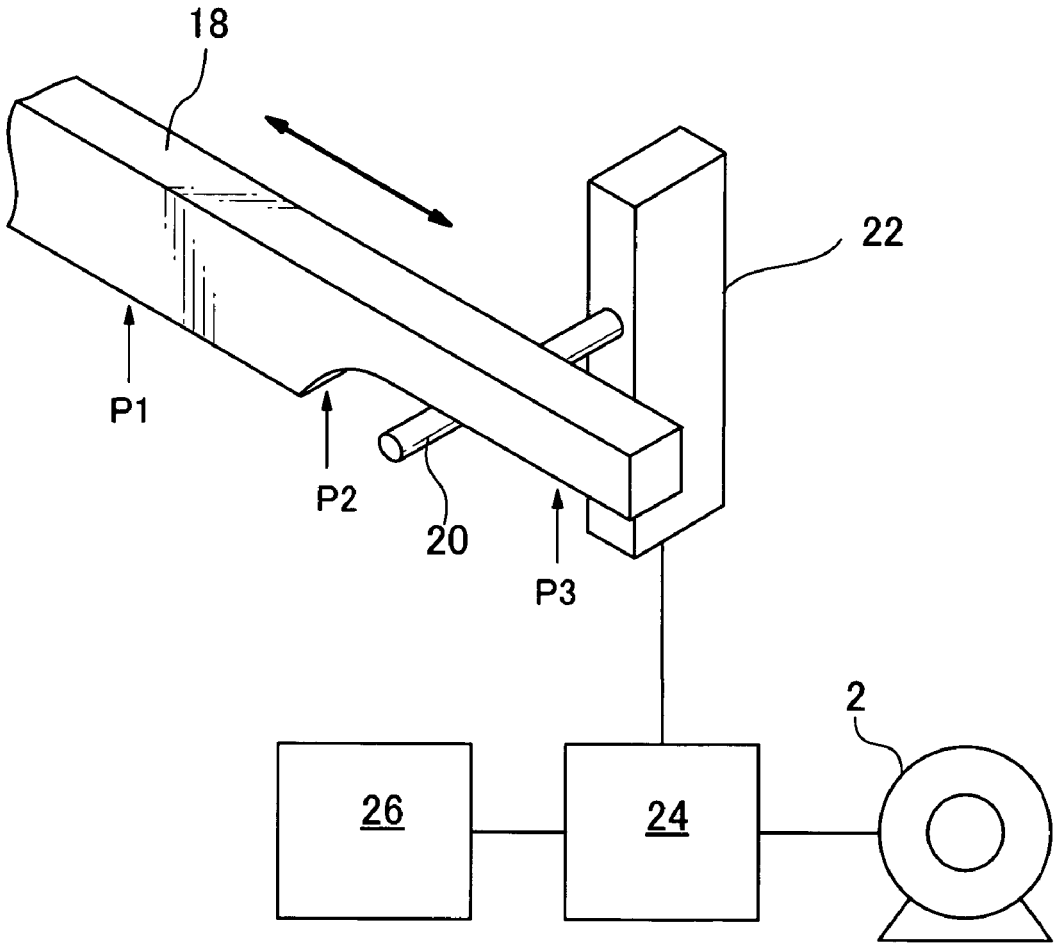
FIG. 3 is a perspective view illustrating a mechanism for changing the rotational speed of a motor of the apparatus according to the preferred embodiment of the present invention.

The configuration of the extension bar 18 with shoulder portion and the limit switch 22 will now be explained with reference to FIG. 3. The extension bar 18 attached to the shuttle box 10 is longitudinally reciprocated with the shuttle box. As shown in FIG. 3, the flexible lever 20 attached to the limit switch 22 is arranged to be in constant contact with the extension bar 18. The flexible lever 20 is bent by the shoulder portion of the extension bar 18 when the extension bar 18 is moved ahead. The shoulder portion of the extension bar 18 is rounded so that the flexible lever 20 is smoothly bent. The limit switch 22 is switched when the flexible lever 20 is bent. The inverter 24 is connected to the limit switch 22, and when the limit switch 22 is switched, the inverter 24 changes the speed of the motor 2.

The apparatus 1 according to this embodiment of the present invention further comprises a yarn beam 28 on which the warp A is wound, a back beam 30 for guiding the warp A from the yarn beam 28, lease rods 32 inserted into the warp A, two healds 34*a* and 34*b* that pull the warp A up or down at predetermined timing in order to form a shed C, a breast beam 36 guiding the warp A passing through the heald 34*a* and 34*b* and the reed 16, and a take-up roller 38 for taking up the fabric produced.

The apparatus 1 according to this embodiment of the present invention further comprises two treadles 40*a* and 40*b* that pull down the healds 34*a* and 34*b*, respectively, a tappet 42 downwardly pushing against each treadle 40 at predetermined timing, a bottom shaft 44 to which the tappet 42 is attached, a large gear 46 attached to the bottom shaft 44, and a small gear 48 attached to the crank shaft 6 and engaged with the large gear 46.

The threads of warp A pass through either the heald 34*a* or the heald 34*b*. The bottom ends of the healds 34*a* and 34*b* are connected to end portions of the treadles 40*a* and 40*b*, respectively. The other end portions of the treadles 40*a* and 40*b* are pivotably supported. As the gear ratio of the small gear 48 attached to the crank shaft 6 to the large gear 46 attached to the bottom shaft 44 is 1:2, if the crank shaft 6 rotates 2 revolutions, the bottom shaft 44 will rotate 1 revolution. The tappet 42 attached to the bottom shaft 44 includes two generally circular members 42*a* and 42*b*, which are secured to the bottom shaft 44 at an eccentric position of the circular members 42*a* and 42*b*. The two generally circular members 42*a* and 42*b* are overlapped so that the point on the circular member 42*a* that is most distant from the bottom shaft 44 lies on the side opposite to the point on the circular member 42*b* that is most distant from the bottom shaft 44. The bottom shaft 44 is arranged so that the circular member 42*a* downwardly pushes the treadle 40*a* to pull down the heald 34*a* and the circular member 42*b* downwardly pushes the treadle 40*b* to pull down the heald 34*b* during one revolution of the bottom shaft 44.

Figure 4:
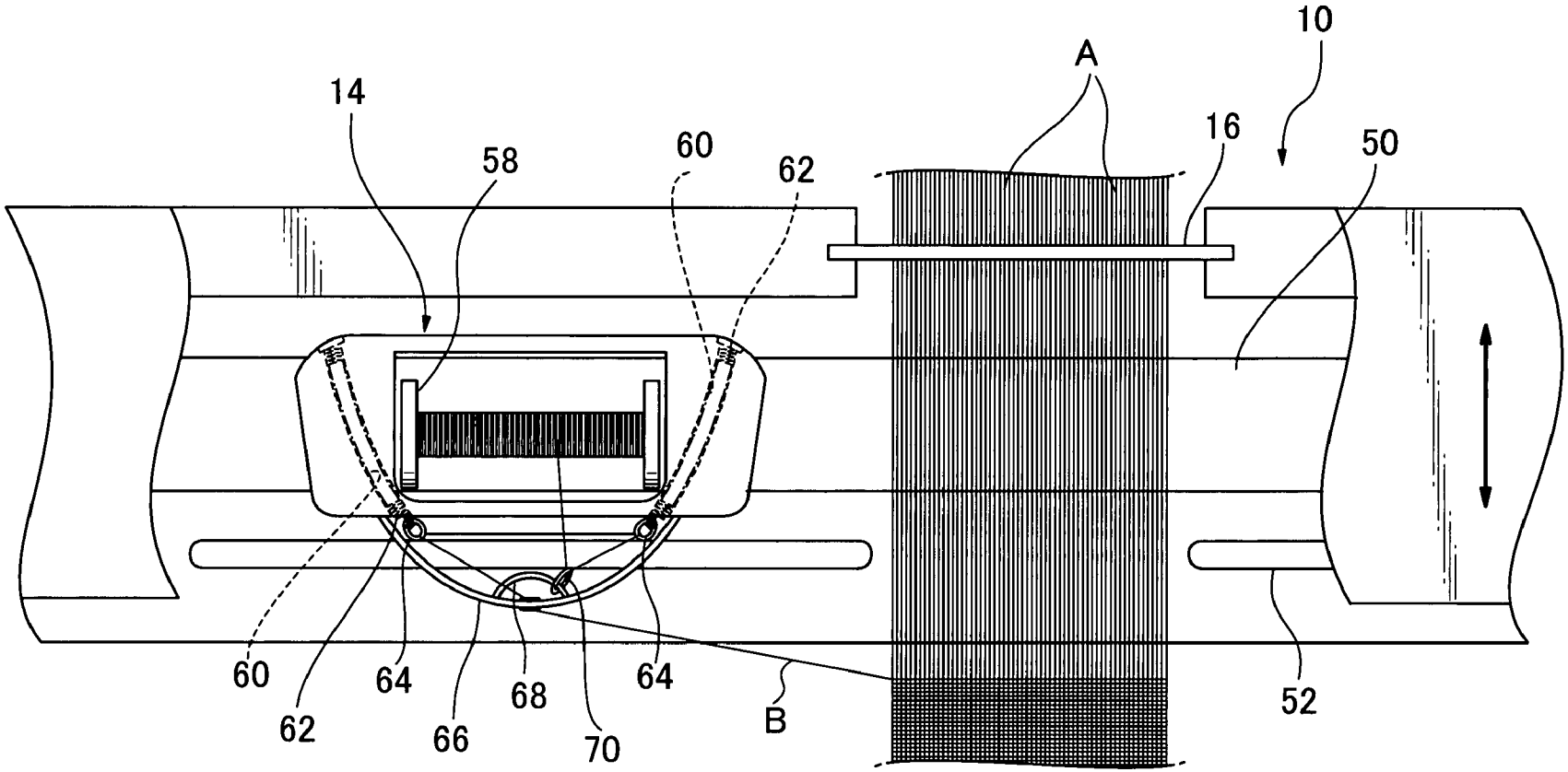
FIG. 4 is a plan view illustrating a shuttle and a shuttle box of the apparatus according to the preferred embodiment of the present invention.
Figure 5:
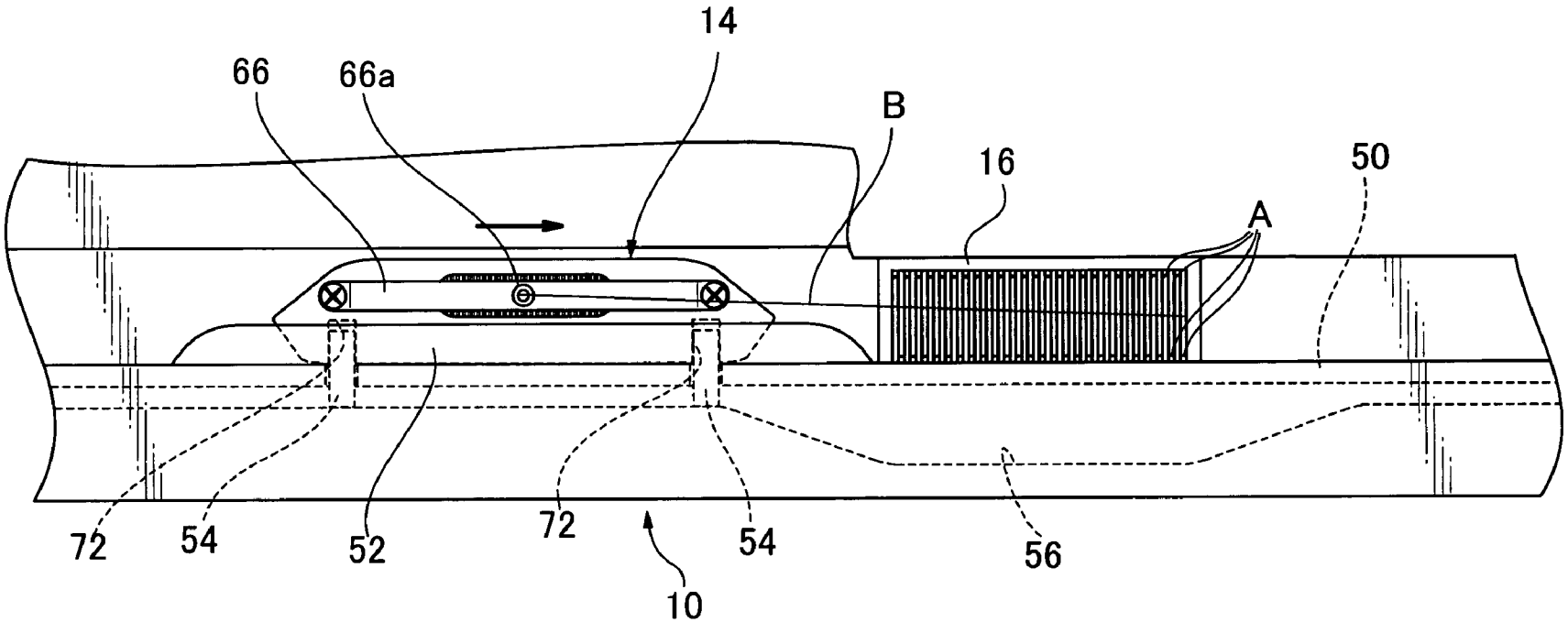
FIG. 5 is a front elevation view illustrating a shuttle and a shuttle box of the apparatus according to the preferred embodiment of the present invention.

The structure of the shuttle 14 and the shuttle box 10 will now be explained with reference to FIGS. 4 and 5. FIG. 4 is a plan view of the shuttle 14 and the shuttle box 10, and FIG. 5 is a front view of the same. The shuttle box 10 is shown partly cut off to simplify the figures. As shown in FIGS. 4 and 5, the shuttle box 10 comprises two tangs 54 inserted into apertures formed on a bottom surface of the shuttle 14 to drive the shuttle 14 in the horizontal direction across the warp A, a sliding plate 50 that retains the tangs 54 allowing movement in the vertical direction and drives the tangs 54 in the horizontal direction, a guide rail 56 located below the sliding plate 50 and guiding the vertical motion of the tangs 54, and guide members 52 guiding the horizontal motion of the shuttle 14.

The shuttle 14 comprises a bobbin 58 that is rotatably supported and on which the weft thread is wound, two coil springs 62 positioned in passages 60 formed through the body of the shuttle 14, one end of the coil springs 62 being attached to the body of the shuttle, rings 64 attached to the ends of the coil springs 62, an arcuate member 66 in the form of an arch and secured to the front of the body of the shuttle 14, a semicircular member 68 attached to the top portion of the arcuate member 66, a ring 70 through which the semicircular member 68 is inserted, and two apertures 72 formed on a bottom surface of the shuttle 14 and receiving the tangs 54. An aperture 66*a* is formed on the top portion of the arcuate member 66 for passage of the weft thread.

The rotation of the crank shaft 6 causes the shuttle box 10 to be reciprocated in longitudinal direction through the connecting rod 8. The sliding plate 50 supported by the shuttle box 10 is laterally reciprocated above the guide rail 56 to synchronize with the reciprocating motion of the shuttle box 10. The elevation of the guide rail 56 is high on both side of the warp A and is low below the warp A.

When the sliding plate 50 is reciprocated, the tangs 54 protruding from the sliding plate 50 are laterally reciprocated with the sliding plate 50. As the tangs 54 are slidable in vertical direction relative to the sliding plate 50, the tangs 54 are moved in the vertical direction along the contour of the guide rail 56. Therefore, the tangs 54 are retracted into the sliding plate 50 when they are located under the warp A and are projected from the sliding plate 50 when they are both located on the side of the warp A. As the shuttle 14 in the shuttle box 10 has the apertures 72 for accepting the tangs 54, the shuttle 14 is driven in the lateral direction across the warp A.

Next, the operation of the apparatus for manufacturing a fabric according to this preferred embodiment of the present invention will be explained. First, the threads of the warp A to be woven by winding them in parallel around the yarn beam 28. The yarn beam 28 is set at a predetermined position of the apparatus 1, and the warp A is passed through the back beam 30, lease rods 32, and healds 34*a* or 34*b*. In this embodiment, the threads of the warp A are alternately inserted into the healds 34*a* and 34*b*. The warp A passing through the healds 34*a* or 34*b* is passed through the reed 16 and breast beam 36 and wound around the take-up roller 38.

The thread of the weft B is prepared. The thread of the weft B is wound around the bobbin 58 and the bobbin 58 is set in the shuttle 14. The thread of the weft B is drawn from the bobbin and passed through the ring 70 attached to the semicircular member 68 of the shuttle 14. The thread of the weft B passed through the ring 70 is passed through the ring 64 attached to the distal end of the coil spring 64, and then passed through the another ring 64 attached to the distal end of the another coil spring 64, and lastly passed through the aperture 66*a* formed on the top of the arcuate member 66. After preparation of the thread of the weft B, the shuttle 14 is positioned in the shuttle box 10. It is necessary to position the shuttle 14 so that the tangs 54 projecting from the sliding plate 50 of the shuttle box 10 are inserted into the apertures 72 formed on the bottom of the shuttle 14.

The shedding motion, one of the primary motions of the apparatus 1, will be explained. The rotation of the motor 2 is transmitted through the belt to the pulley 4 and the rotation of the pulley 4 is transmitted to the small gear 48 secured to the crankshaft 6. The rotation of the small gear 48 is transmitted to the large gear 46 engaged with the small gear 48, and the bottom shaft 44 secured to the large gear 46 is rotated. The rotation of the bottom shaft 44 rotates the tappet 42 attached thereto. As shown in FIG. 2, in a position where the circular member 42*a* of the tappet 42 is lowered, the treadle 40*a* is downwardly pushed and the heald 34*a* connected to the treadle 40*a* is lowered. On the other hand, in this position, the circular member 42*b* of the tappet 42 is raised and the treadle 40*b* is not pushed, thus the heald 34*b* connected to the treadle 40*b* is raised. As a result, the part of the warp A passed through the heald 34*a* is lowered and the part of the warp A passed through the heald 34*b* is raised, thus a shed C is formed between the lowered part of the warp and the raised part of the warp.

When the bottom shaft 44 rotates about ninety degrees and the circular members 42*a* and 42*b* of the tappet 42 are located on the same level, the shed C is closed because the treadles 40*a* and 40*b* are not lowered and healds 34*a* and 34*b* are on the same level. When the bottom shaft 44 further rotates about ninety degrees and the circular member 42*b* of the tappet 42 is at a lower position and the circular member 42*a* is at an upper position, the heald 34*b* is lowered and the heald 34*a* is raised, thereby forming the shed C. Since the gear ratio of the small gear 48 and the large gear 46 is 1:2, when the crankshaft 6 rotates two revolutions, the bottom shaft 44 rotates in one revolution. Further, while the bottom shaft 44 rotates one revolution, the shed C is formed twice, Thus the shed C is formed once during each revolution of the crankshaft 6.

Next, a picking motion, one of the primary motions of the apparatus 1 for manufacturing a fabric according to the preferred embodiment of the present invention, will be explained. The motor 2 drives the crankshaft 6 and the connecting rod 8 connected to the crankshaft 6 reciprocates the shuttle box 10 in the longitudinal direction. This reciprocating motion causes the sliding plate 50 to reciprocate in the lateral direction by means of a sliding plate drive mechanism (not shown). The shuttle 14 is laterally reciprocated together with the sliding plate 50, since the two apertures 72 formed on the bottom surface of the shuttle 14 receive the two tangs 54. In a step for initiating the picking motion, the shuttle 14 slowly starts to accelerate from the position most distant form the warp A toward the warp A. The velocity of the shuttle 14 is fastest in the step of picking motion in which the shuttle 14 passes through the shed C. Then, in a step for terminating the picking motion, the shuttle 14 starts to decelerate from the position where the shuttle 14 has passed through the shed C and stops at the point most distant from the warp A. Again, the shuttle 14 starts to accelerate toward the warp A in the reverse direction in another step for initiating a picking motion. By repeating these motions, the shuttle 14 successively passes the thread of the weft B between the threads of the warp A.

As shown in FIG. 5, when the shuttle 14 moves rightward and approaches the warp A, causing the tangs 54 inserted into the apertures 72 of the shuttle 14 to approach the position where the elevation of the guide rail 56 is low, the tang 54 on the right side goes down and comes out of the aperture 72. Thus, when the shuttle 14 approaches the warp A, the tang 54 on the right side first starts to go down along the guide rail 56 and the tang 54 on the right side is not upwardly projected from the sliding plate 50 below the warp A. Next, when the shuttle 14 is moved farther and the tang 54 on the left side approaches the warp A, the tang 54 on the left side also starts to go down and to come out of the aperture 72. At the same time, the tang 54 on the right side starts to go upwardly along the guide rail 56 and is inserted into the aperture 72 of the shuttle 14. Then, when the shuttle 14 is moved farther and the tang 54 on the left side also passes through the warp A, the tang 54 on the left side also starts to go upwardly and is inserted into the aperture 72.

Next, a beating motion, one of the primary motions of the apparatus 1 according to the preferred embodiment of the present invention, will be explained. The motor 2 drives the crankshaft 6 and the connecting rod 8 connected to the crankshaft 6 reciprocates the shuttle box 10 in longitudinal direction. When the shuttle box 10 is reciprocated and the reed 16 attached to the shuttle box 10 is also reciprocated, the reed 16 draws up the thread of weft B passed through the shed C into the near side.

Figure 6A:
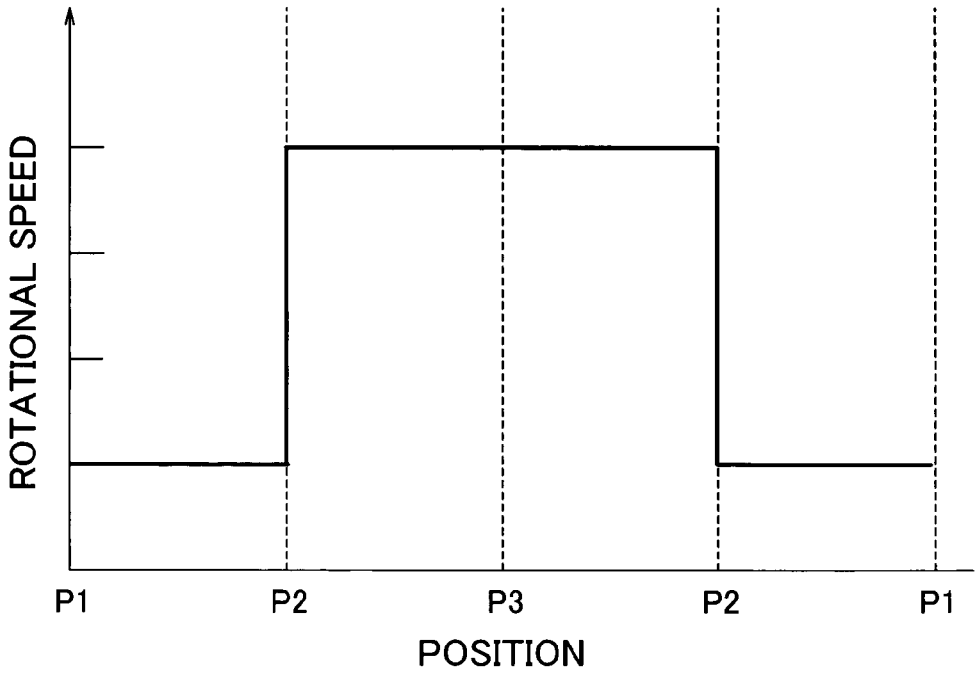
FIG. 6A is a graph showing the relationship between contacting position of a flexible lever and rotational speed.
Figure 6B:
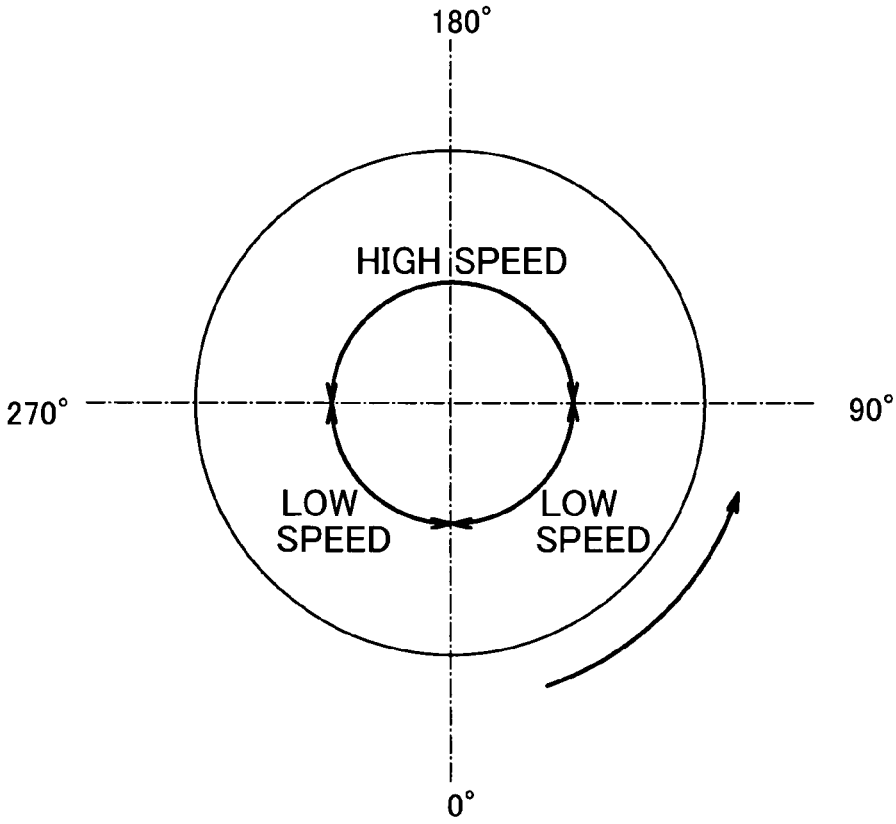
FIG. 6B is a graph showing the relationship between rotational angle of a crankshaft and rotational speed.

Referring FIGS. 3 and 6, the timing of the primary motions and the rotating speed of the motor 2 of the apparatus 1 according to this preferred embodiment of the present invention will be explained. FIG. 6A shows the relationship between the contacting point on the extension bar with the flexible lever 20 and the rotating speed of the crankshaft 6. FIG. 6B shows a relationship between the rotating angle and the rotating speed of the crankshaft 6. The three primary motions explained above, i.e., the shedding motion, the picking motion and the beating motion, are generated by motive power of the motor 2 and are synchronized with the rotation of the motor 2. At a moment of the beating i.e. the moment when the shuttle box 10 is most advanced toward the near side, the shuttle box 10 is stopped and the flexible lever 20 attached to the limit switch 22 is downwardly bent by abutting on the point P1 of the extension bar 18 attached to the shuttle box 10. This moment corresponds to the point P1 on the left end of the graph of FIG. 6A and corresponds to the point of zero degree in FIG. 6B (the direction of zero degree in FIG. 6B does not correspond to the crank angle of the crankshaft 6). While the flexible lever 20 is downwardly bent, the limit switch 22 is on and the inverter 24 is operated to reduce the rotating speed of the motor 2.

After the beating motion, when the shuttle box 10 starts to move backward, the circular member 42*a* or 42*b* of the tappet 42 starts to push the treadle 40 down and the shed C is opened. Further, the shuttle 14 in the shuttle box 10 starts to accelerate toward the warp A. This motion corresponds to the left end section between the points P1 and P2 in FIG. 6A and corresponds to the section between the angles 0 to 90 in FIG. 6B. When the shuttle box 10 further moves backward and the flexible lever 20 is abutted on the point P2 of the extension bar 18, the shed C is completely opened and the shuttle 14 approaches the shed C.

When the shuttle box 10 further moves backward and the flexible lever 20 passes beyond the point P2, the flexible lever 20 is no longer bent and the limit switch 22 is turned off. When the limit switch 22 is off, the operation of the inverter 24 is stopped to increase the speed of the motor 2. When the flexible lever 20 passes beyond the point P2, the shuttle 14 is running within the shed C and the shed C is maintained at full-open position. This motion corresponds to the section between the point P2 on left side and the point P3 in FIG. 6A and corresponds to the section between the angles 90 and 180 degrees in FIG. 6B.

When the shuttle box 10 moves to the position where the flexible lever 20 is in contact with the point P3 of the extension bar 18, the moving direction of the shuttle box 10 is changed and the shuttle box 10 starts to move foreward. While the shuttle box 10 is moving between the first position in which the flexible lever 20 is in contact with the point P3 and the second position in which the flexible lever 20 is in contact with the point P2, the limit switch 22 is off and the rotating speed of the motor 2 is high. In this period, the shuttle 14 is still located within the shed C and the shed C is maintained at full-open position. This motion corresponds to the section between the point P3 and the point P2 on right side of FIG. 6A and corresponds to the section between the angles 180 and 270 degrees in FIG. 6B.

When the shuttle box 10 further moves in foreward and the flexible lever 20 comes in contact with the point P2 of the extension bar 18, the flexible lever 20 is bent again and the limit switch 22 is turned on, whereby inverter 24 is operated to reduce the rotating speed of the motor 2. At this moment, the shuttle 14 has been passed through the shed C and starts to decelerate and the shed C starts to close. This motion corresponds to the section between the point P2 on right side and the point P3 on the right side in FIG. 6A and corresponds to the section between the angle 270 and 0 in FIG. 6B. When the shuttle box 10 further moves in foreward and the flexible lever 20 comes in contact with the point P1 of the extension bar 18, the reed 16 attached to the shuttle box 10 draws up the thread of weft B into the near side by the beating motion. At this moment, the shuttle 14 is stopped and the shed C is closed. By repeating these motions, the threads of the weft B are passed across the warp A one after another.

In this embodiment, during the steps for initiating the picking motion and for terminating the picking motion in which the limit switch 22 is on, the motor 2 is driven so as to rotate the crankshaft 6 at 20 rpm. During the step of picking motion, in which the limit switch is off, the motor 2 is driven so as to rotate the crankshaft 6 at 80 rpm. In this embodiment, transparent films of narrow width are utilized as the threads of the warp A, and a 24-carat gold monofilament having a diameter of 30 micrometer is utilized as the thread of the weft B.

The apparatus for manufacturing a fabric according to this preferred embodiment of the present invention can produce a fabric from very weak filament which has been impossible to produce using a conventional apparatus. This is possible because, during the step for initiating a picking motion in which the thread of the weft B is accelerated toward the shed C and the step for terminating the picking motion in which the thread of the weft B is decelerated, the crankshaft 6 is rotated at low speed and the force applied to the thread of weft B is very weak. Further, problems such as loosening of the weft B are prevented and the fabric productivity is enhanced by the apparatus according to this preferred embodiment of the present invention. This because, during the picking motion in which the shuttle 14 is passed through the shed C, the crankshaft 6 of the apparatus according to this preferred embodiment is rotated as fast as the crankshaft of a conventional apparatus.

Although a preferred embodiment according to the present invention has been explained, the preferred embodiment can be modified. In the embodiment set forth above, the present invention is applied to an apparatus for manufacturing a narrow width fabric utilizing a shuttle. However, the present invention can be applied to an arbitrary weaving apparatus such as an apparatus for manufacturing a broad width fabric, a shuttle-less weaving apparatus and a needle weaving apparatus. In the embodiment set forth above, 24-carat gold monofilament is used to produce a fabric, but any of various other very weak fibers can also be woven by the apparatus according to the present invention. Further, in the preferred embodiment set forth above, transparent films are utilized as the treads of the warp A and a 24-carat gold monofilament is utilized as the thread weft B. However, a very weak fiber such as a 24-carat gold monofilament can be also utilized for the warp. In the preferred embodiment set forth above, a plain weave fabric is produced, but various types of fabric can be woven by the apparatus according to the present invention by using more than two healds.

Further, in the preferred embodiment set forth above, the limit switch is switched by the extension bar having the shoulder portion that is reciprocated together with the shuttle box in order to vary a rotating speed of the motor. However, the extension bar can be replaced by a cam or tappet. That is, it is possible to attach a cam or tappet to the crankshaft or a shaft rotatingly synchronized with the crankshaft and use this cam or tappet to switch the limit switch at predetermined rotating angles.

What is claimed is:

1. A method for manufacturing a fabric using a power loom driven by driving means, comprising the steps of:

(a) separating a warp into an upper part and a lower part to form a shed by means of rotation of said driving means;

(b) accelerating a weft thread toward said shed by means of rotation of said driving means;

(c) passing said weft thread through said shed by means of rotation of said driving means;

(d) decelerating said weft thread passed through said shed by means of rotation of said driving means;

(e) returning said warp to close said shed by means of rotation of said driving means; and (f) beating said weft thread inserted into said warp in said step (c) to draw up said weft thread into near side by means of rotation of said driving means;

a rotational speed of said driving means during said steps (b) and (d) being lower than a rotational speed of said driving means during said step (c).

2. A method for manufacturing a fabric according to claim 1, wherein said rotational speed of said driving means during said steps (b) and (d) is ¼ or less the rotational speed of said driving means during said step (c).

3. A method for manufacturing a fabric according to claim 1, wherein said driving means is an electric motor and said rotational speed of said electric motor is varied by an inverter.

4. A method for manufacturing a fabric according to claim 1, wherein said driving means is an electric motor and said rotational speed of said electric motor is varied by switching a switch in response to a beating motion by which a reed is moved.

5. An apparatus for manufacturing a fabric comprising: driving means for generating rotational force;

healds for transferring a warp upward or downward to form a shed at predetermined timing in response to a rotation of said driving means;

a shuttle for holding a weft thread and transferred into said shed so as to cross said warp at predetermined timing in response to a rotation of said driving means;

a shuttle box for slidably supporting said shuttle and picking said shuttle into said shed at predetermined timing in response to a rotation of said driving means;

a reed attached to said shuttle box for beating said weft thread inserted into said warp by picking said shuttle, said reed being reciprocated at predetermined timing by means of a rotation of said driving means to draw up said weft thread into a near side; and means for varying rotational speed of said driving means at predetermined timing, wherein said means for varying rotational speed decreases rotational speed of said driving means at least when said shuttle is accelerated toward said shed and when said shuttle is decelerated after passing through said shed.

6. An apparatus for manufacturing a fabric according to claim 5, wherein said driving means is an electric motor and said means for varying rotational speed is an inverter connected to said electric motor.

7. An apparatus for manufacturing a fabric according to claim 5, wherein said apparatus further comprises a limit switch that is switched by means of reciprocating motion of said shuttle box and said means for varying rotational speed varies rotational speed of said driving means on the basis of the position of said limit switch.

* * * * *